United States Patent [19]

Wells

[11] Patent Number: 4,781,303

[45] Date of Patent: Nov. 1, 1988

[54] CONTAINER WITH A NON-REMOVABLE OPENING TAB APPARATUS

[76] Inventor: Robert A. Wells, 13 Fairway Dr., Kennesaw, Ga. 30144

[21] Appl. No.: 173,600

[22] Filed: Mar. 25, 1988

[51] Int. Cl.[4] ..... B65D 41/32

[52] U.S. Cl. ..... 220/269

[58] Field of Search ..... 220/267-273

[56] References Cited

U.S. PATENT DOCUMENTS

| | | | |
|---|---|---|---|
| 3,977,561 | 8/1976 | Strole et al. | 220/269 |
| 4,039,100 | 8/1977 | Wells | 220/269 |
| 4,148,409 | 4/1979 | Zundel | 220/267 |

*Primary Examiner*—George T. Hall

*Attorney, Agent, or Firm*—Thomas & Kennedy

[57] ABSTRACT

An easy-opening container of the type commonly used to contain beverages has an end wall that includes a score line and a hinge line with the score and hinge lines together defining a partially separable panel section of the end wall. A pull tab has a ring-shaped lift portion at one end, a finger at its other end and a mounting portion intermediate its ends. The pull tab is mounted at its mounting portion to the end wall adjacent the panel section with the lift portion extending from the mounting portion to overlie and partially frame the panel section and with the finger extending away from the panel section to overlie a portion of the end wall. A locking flange depends from the lift portion to lie in confronting relationship with at least a portion of the periphery of the panel section. The finger is constructed and arranged to engage a portion of the end wall upon movement of the lift portion away from the end wall at least partially separating the panel section from the end wall to define an opening therein. The flange is constructed and arranged to move into locking engagement with the edges defining the opening upon subsequent movement of the lift portion toward the end wall so that the pull tab is maintained in a fixed orientation atop the end wall framing the opening.

40 Claims, 5 Drawing Sheets

CONTAINER WITH A NON-REMOVABLE OPENING TAB APPARATUS

TECHNICAL FIELD

This invention relates to easy opening containers and particularly to easy opening containers having tear tabs or other elements that remain attached to the container after it is opened.

BACKGROUND OF THE INVENTION

Beverage containers equipped with easy opening "pop-tops" have been available for many years. A more recent development in the container art is the familiar easy opening container havng a scored panel that opens and folds into the container in response to the lifting of a tab that remains attached to the opened container. This later type of easy opening container was developed primarily in response to problems associated with the original pop-top that separted from its container, contributd to unsightly litter and tended to have sharp edges representing a danger to the public.

Although the more recent "non-detachable" tabs are an improvement over the original "pop-top", they have proven to be replete with problems of their own. After having been used to open a container, the tabs serve no further pupose and, in many cases, are a frustrating obstruction to a consumer attempting to drink the beverage from the container. Further, the tabs are easily removed from the container by simply wiggling them until they become separated from the container. Such removal of the tabs raises new concerns within the beverage industry and among environmentalists. In addition, removal of these tabs often leaves a sharp protrusion on the container and on the tab which can be dangerous to the consumer and to the public.

A further problem associated with currently manufactured easy opening containers is a frustrating tendency for the tab to break off without opening the container. In addition, the increasing complexity of the mechanism results in a very high cost of manufacture.

A phenomenon known as "blow-out" has also been known to occur in which pressure within the container causes the scored panel to become detached and propelled from the container injuring a consumer.

Attempts have been made to provide easy opening containers that overcome the problems of the currently used designs. The prior art includes the following listed U.S. Pat. Nos. 3,807,597, 3,860,143, 3,977,561, 4,039,100, 4,148,409.

The devices disclosed in these patents show other attempts to solve some of the above-mentioned problems.

Thus, a need exists for an easy opening container having an opening mechanism that overcomes the problems associated with the prior art devices. It is to the provision of such a container that the present invention is primarily directed.

SUMMARY OF THE INVENTION

The present invention comprises an easy opening container of the type commonly used with beverages and includes a container end wall having a generally openable panel defined by a score or selectively separable region of predetermined weakness in the material of the container end wall. An interruption in the score at a predetermined position on the container end wall provides a hinged attachment of the panel to the container end wall upon separation of the score. An opening tab is hingedly attached with a rivet to the container end wall adjacent the openable panel and includes a generally annular lift portion having a size corresponding substantially to that of the openable panel.

Prior to opening the lift portion of the opening tab lies atop the can end in substantial alignment with the openable panel. The inner periphery of the lift portion has a downwardly extending flange that is adapted to engage and "snap" into the opening formed in the container end wall upon separation of the openable panel from the end wall. The opening tab also includes an outwardly extending finger that is adapted to engage a lift stop formed in the can end wall when the lift portion is raised by a user.

When it is desired to open a container embodying the present invention, a user simply grasps and raises the lift portion of the tab. As the lift portion begins to move away from the container end wall, the end wall material is deformed slightly adjacent the rivet causing the portion of the score nearest the rivet to separate, releasing pressure from within the container. As the lift portion moves further, the finger of the tab pivots downwardly and engages the lift stop of the end wall on the opposite side of the rivet such that an upward force is exerted on the rivet introducing fatigue in the container end wall material. The released pressure from the contents of the container in conjunction with the fatigue occurring in the end wall results in a flexing of the container end wall causing the score to separate virtually along its entire length which substantially separates the openable panel from the container end wall.

With the container opened, the annular lift portion of the tab is pressed downwardly into engagement with the container end wall where the flange snaps into locking engagement with the edges of the opening formed in the end wall. This action causes any unseparated portion of the panel to separate from the end wall along the score and causes the openable panel to hinge downwardly into the container. With the lift portion locked into place it is difficult to remove, greatly reducing the likelihood that the tab will be removed from the container end wall and discarded. Further, the annular lift portion covers the sharp exposed edges of the opening in the end wall, reducing the chance that a user will be cut or otherwise injured by the can.

Thus, a unique easy opening container is provided that is simply constructed and easy to use. The opening tab not only serves to open the container but also provides a safe rim covering sharp edges of the opening after the container has been opened. The tab is not in a position to contact a user's nose or otherwise be an obstruction to drinking beverage from the container and, since the tab locks securely into the opening, the likelihood that it will be twisted off and discarded by a user is virtually eliminated. An added advantage is the prevention of a dangerous "blow out" by virtue of the lift portion of the tab overlying the openable panel. This configuration prevents the panel from leaving the container even if it is dislodged from the container end wall.

Many other advantages, features and objects of the present invention will become readily apparent upon reading the following description in conjunction with the attached drawings.

DETAILED DESCRIPTION

Figure 1:
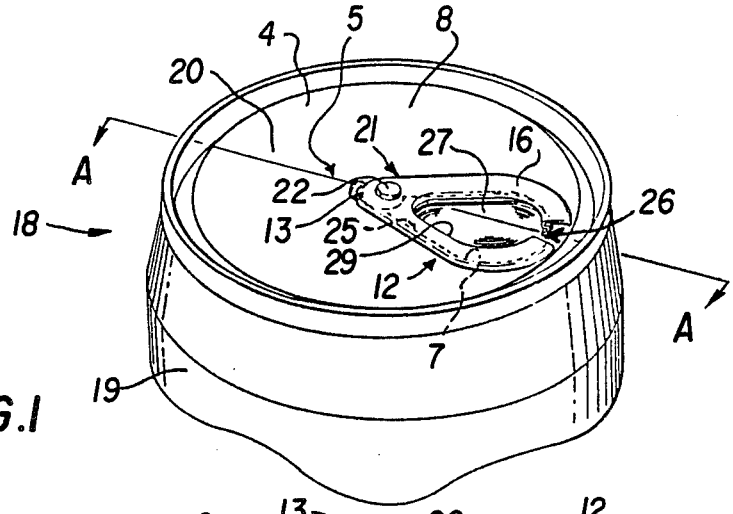
FIG. 1 is a perspective view of an end portion of a container having an easy opening mechanism embodying the principles of the present invention.

Referring now in more detail to the drawings in which like numerals represent like parts throughout the several views, FIGS. 1-6 illustrate a first embodiment of the present invention. FIG. 1 shows a container 18 such as a conventional beverage can, having a substantially cylindrical body 19 and an end wall 20. The end wall 20 has an outer surface 8 and an inner surface 9 and includes a peripheral portion 4 and a central portion 5. An openable panel 27, defined by the broken line in FIG. 1, is formed in the end wall 20 hy a line of weakness 25 formed in the material of the end. The line of weakness 25 can be formed by any suitable operation such as coining, folding or, as in the present embodiment, scoring.

Figure 2B:
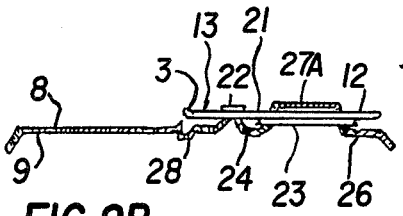
FIG. 2B is a sectional view, similar to FIG. 2A, but showing the separable panel as convex.

Although the scoring in the present embodiment is depicted as being provided on the outer surface 8 of the end wall 20, that is, the side of the end wall 20 facing the exterior of the container 18, the scoring 25 can optionally be provided on the inner surface 9 of the end wall 20 or on both sides thereof in opposed or unopposed alignment. The openable panel 27 can be flat, concave (FIG. 2A) or convex (FIG. 2B). The present embodiment of the openable panel 27 is defined along both sides thereof by the scoring 25, and is defined along one end by an unscored segment 26. The purpose of the unscored segment 26 is to provide a hinged attachment of the panel 27 to the end wall 20 allowing the panel to hinge downwardly into the container upon opening as discussed hereinafter.

Opening tab 21. shown in FIGS. 1, 2, 3 and 3*a*, is hingedly attached to the end wall 20 by a suitable attachment device such as a rivet 22 affixed to or through the end wall 20. The opening tab 21 has a generally annular lift portion 12 that includes an aperture 29 (FIG. 3) defined by a surrounding rim 16. The area 24 (FIG. 3) of the end wall 20 adjacent the score line 25 at the rivet 22 performs a particular function in conjunction with release of pressure from the container upon the lifting of the opening tab 21 as further discussed below. This area 24 of the end wall 20 is called the pressure release area or vent area.

Disposed on the underside of the lift portion 12 is a locking flange 23 (FIGS. 2 and 3A) which lies in confronting relationship with at least a portion of the score 25.

Figure 2A:
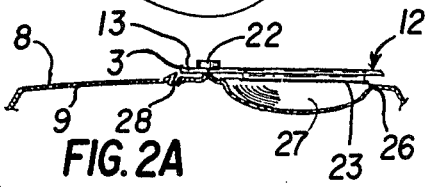
FIG. 2A is a sectional view taken along line A—A of FIG. 1.
Figure 3:
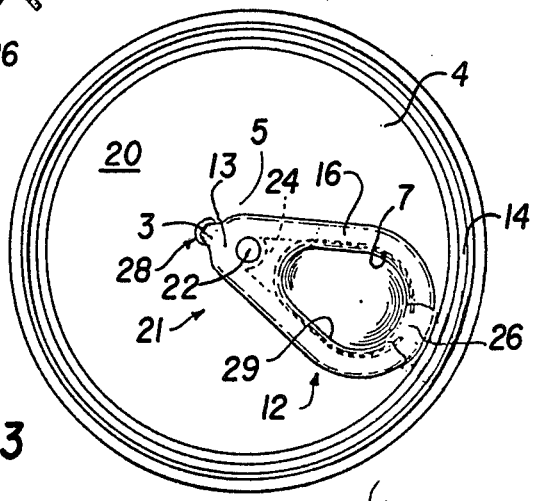
FIG. 3 is a top plan view of the container end wall shown in FIG. 1.
Figure 3A:
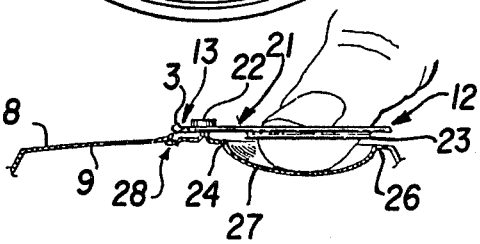
FIG. 3A is a section view taken along lines A—A of FIG. 1 showing the initial step in the process of opening a container embodying the present invention.
Figure 4:
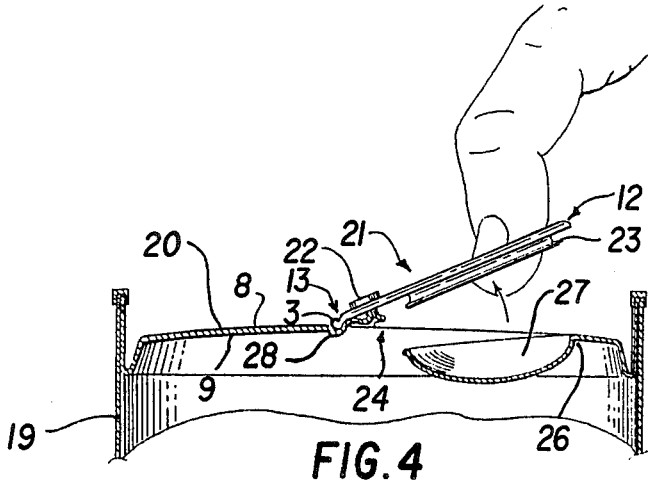
FIG. 4 is a section view along line A—A of FIG. 1 showing the lift portion of the opening tab being raised to separate the score defining the openable panel.

It can be seen from FIGS. 1 and 3 that the score 25 defining the openable panel 27 in the present embodiment extends from unscored segment 26 to the vent area 24 adjacent the rivet 22. The pressure release area 24 of the end wall 20 contiguous to score line 25 is separated first adjacent the rivet 22 as the lift portion 12 is moved away from the end wall 20 as shown in FIGS. 3*a* and 4. Tab lift stop 28 is formed in end wall 20 and is configured to be engaged by the finger 13 to restrict the upward movement of the lift portion 12 and to introduce fatigue into the material of the end wall. The finger portion 13 can include a stop engagement means 3 for engaging the lift stop 28 as shown in FIGS. 2A and 2B.

It should be noted that the opening tab 21 remains substantially axially aligned with or "frames" the openable panel 27 at all times prior to the opening of the container 18 and that aperture 29 is slightly smaller than panel 27 (FIGS. 1 and 3). This arrangement ensures that the openable panel 27 is not propelled from the container in the event of a "blow out" sometimes associated with such panels.

FIGS. 3*a*, 4, 5 and 6 show successive steps in the process of opening a container having the mechanism of the present embodiment. Typically, a consumer first inserts his finger through the aperture 29 of the lift portion 12 and begins to pull upwardly as shown in FIG. 3*a*. As the finger 13 of opening tab 21 moves, a downward pressure is exerted against the end wall 20 by the finger portion 13 of the tab 12 and an upward force is exerted on the rivet 22. This combined stress causes the material of the container end wall 20 to bend or flex slightly adjacent the rivet 22 and the score line 25 and causes the score 25 to separate first in its pressure release area 24, releasing any pressure within the container. As the lift portion 12 is raised further engagement means 3 of the finger portion 13 of the tab 21 engages lift stop 28 exerting a downward force thereon while continuing to exert an upward force on the rivet 22. The upward force on the rivet 22 introduces fatigue into the material of the end wall 20 causing the score 25 to continue to separate virtually along its entire length separating the openable panel 27 from the container end wall 20 on each side of the hinge means 26.

Figure 4A:
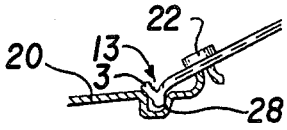
FIG. 4A shows the detail structure of one embodiment of the lift stop structure.
Figure 5:
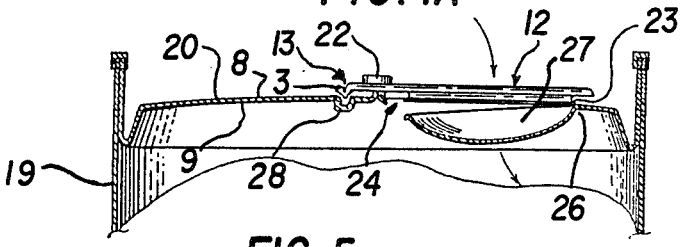
FIG. 5 is a section view along line A—A of FIG. 1 showing the lift portion as it appears after having been moved back into engagement with the can end wall.

After the engagement means 3 of the finger portion 13 has engaged the lift stop 28 and at least a portion of the panel 27 has been separated from the container wall the upward movement of the lift portion 12 is completed. In order to control the extent of the upward movement of the lift portion 12, the engagement means 3 of the finger portion 13 of the tab 21 is adapted to cooperatively engage the lift stop 28, as shown in FIG. 4. The cooperative engagement of the engagement means 3 of the finger 13 with the lift stop 28 determines the extent to which the lift portion 12 of the tab 21 can be raised. FIG. 4*a* illustrates one embodiment of a lift stop structure but it will be understood by those skilled in the art that the finger 13 and the lift stop 28 can be constructed in various ways to achieve the desired results without departing from the scope of the invention.

Figure 6:
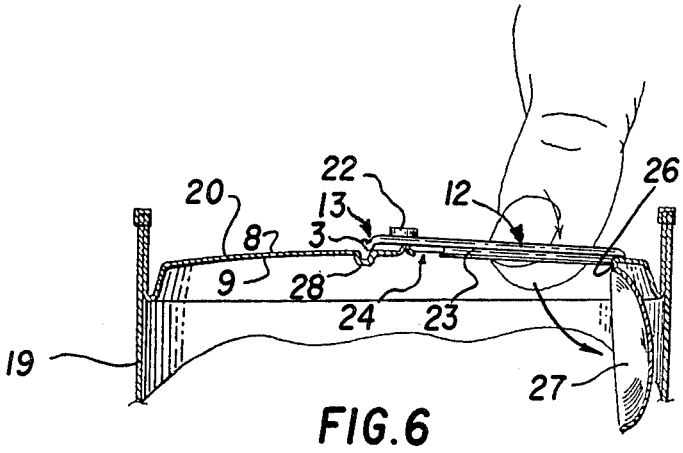
FIG. 6 is a section view along the line A—A of FIG. 1 showing the final step in the opening process of snapping the lift portion into locking engagement with the opening of the end wall.
Figure 7:
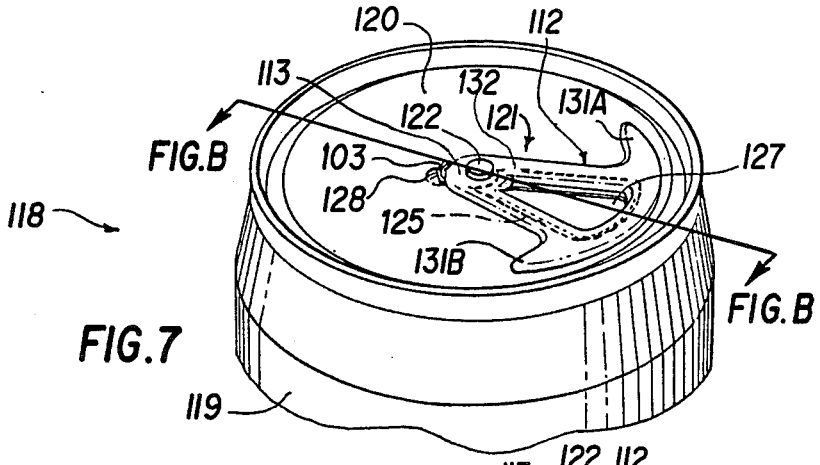
FIG. 7 is a perspective view of a can end including a second embodiment of the present invention.
Figure 8:
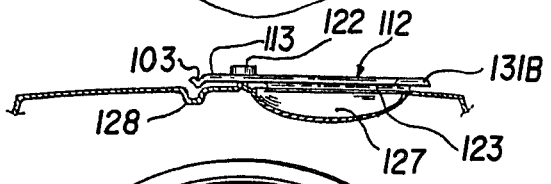
FIG. 8 is a sectional view taken along lines B—B of FIG. 7.

Once the lift portion 12 has been raised and the panel 27 at least partially separated from the end wall 20, the opening process is completed by moving the lift portion 12 down into engagement with the end wall 20 by "snapping" the locking engagement means 23 over the rim of the end wall 20 and into cooperative engagement with at least a portion of the inner surface 9 of the wall 20 as shown in FIG. 6. Movement of the lift portion 12 downward toward the end wall 20 causes any unseparated portion of the score line 25 forming the openable panel 27 to separate and to move the panel inward of the container. The lift portion 12 is then firmly fastened in place by the channel-shaped locking flange 23 in cooperation with at least a portion of rim 7 and the inner surface 9 of the end wall 20 as best seen in FIG. 6.

The user is able to feel when the tab 21 is properly and firmly seated by the "snap" engagement between the flange 23 and the inner surface 9 of the end wall 20. It should be noted that the locking flange 23 of the lift portion 12 need not necessarily extend around the full periphery of the aperture 29 but may extend around only a portion thereof.

When the lift portion 12 has been "snapped" securely into place as shown in FIG. 6, the contents of the container can be poured or consumed directly from the container through the aperture 29 of the lift portion 12. To facilitate a smooth pour of the contents from the container, the vent area 24 provides a passage that permits air to move into the container as the contents are poured.

When the openable panel 27 has been pivoted down inside the container, it is retained by its hinge 26.

The openable panel 27 is shown as being concave in FIGS. 3*a* through 6 to allow a user to insert his finger through the aperture 29 for lifting the opening tab 21 as shown in FIG. 4. Openable panel 27A is optionally shown in FIG. 2B as convex for use as a platform for grasping the opening tab 21.

Figure 9:
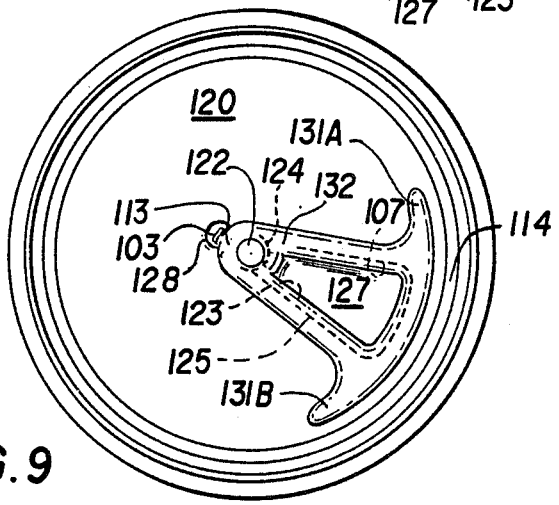
FIG. 9 is a top plan view of the can end of FIG. 7.
Figure 10:
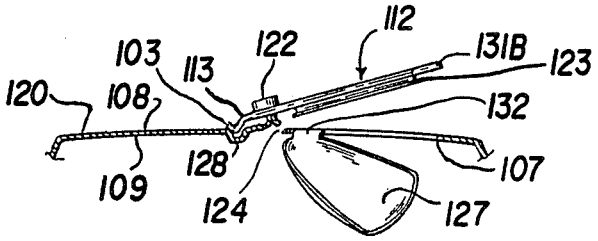
FIG. 10 is a sectional view taken along line B—B of FIG. 7, showing the easy opening mechanism of FIG. 7 in an intermediate opening configuration.

FIGS. 7–10 illustrate a second emodiment of the present invention wherein the opening tab 121 includes a pair of opposed laterally extending finger grips 131*a* and 131*b*. In opening a container including this embodiment, a user can place a finger adjacent the inside portion of each finger grip 131*a* and 131*b* and pull the lift portion 112 from the end member 120. This causes the score 125 to sever in the same way as discussed relative to the first embodiment above. Upon severing the score 125 which separates the openable panel 127 from the container end wall 120, the opening tab 121 is moved back downwardly and snapped into locking engagement over at lest a portion of the rim 107 and the inner surface 109 of the wall 120 as in the first embodiment. This action completes the separation of the score 125 and forces the hinge means 132 of the openable panel 127 to bend downward and the panel 127 to extend into the container as seen in FIG. 10.

While the non-scored hinge portion 132 is shown in one position along score 125 in FIG. 9, it will be understood that the hinge portion 132 can be located alternatively along any other portion of the score. It may, for example, be located adjacent the chime 114 as shown in FIG. 9.

FIGS. 11–16 illustrate a third embodiment of the present invention in which the rivet 222 is located adjacent the chime 214 of the container 218. As in previously discussed embodiments, the third embodiment includes a generally cylindrical body 219 and a generally disk shaped end wall 220 and the rivet 222 is integrally formed with the end wall 220. A concave openable panel 227 is defined in the end wall 220 by a score 225 that is broken at hinge point 232 to provide a hinged attachment of the panel 227 to the end wall 220 upon separation of the score 225. Generally annular opening tab 221 defines an aperture 229 having a size and shape substantially corresponding to that of the panel 227 and normally overlying the panel 227 in general axial alignment. Locking flange 223 extends downwardly from the periphery of the aperture 229 and is adapted to form a locking engagement with at least a portion of the rim 207 and the inner surface 209 of the end wall 220 formed by the separation of the openable panel 227 from the end wall 220.

Finger portion 213 in the present embodiment is a part of the opening tab 221 and extends outwardly therefrom into the chime 214. The finger portion 213 is adapted to cooperate with the chime 214 to limit the upward movement of the opening tab 221 upon the container being opened and to introduce fatigue into the material of the end wall 220.

Figure 11:
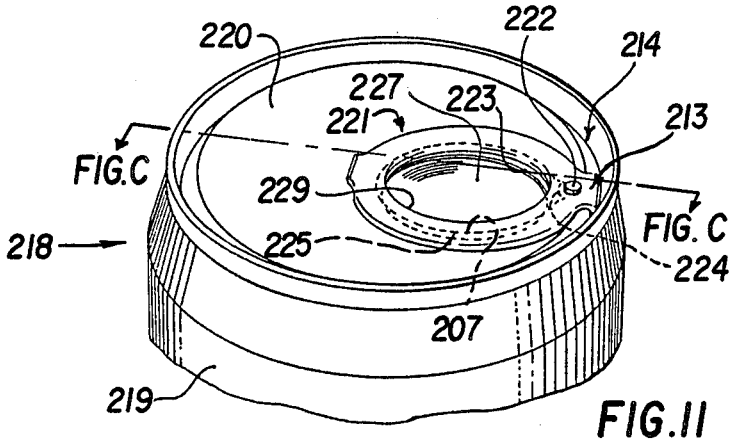
FIG. 11 is a perspective view of a can end including a third embodiment of the present invention.
Figure 12:
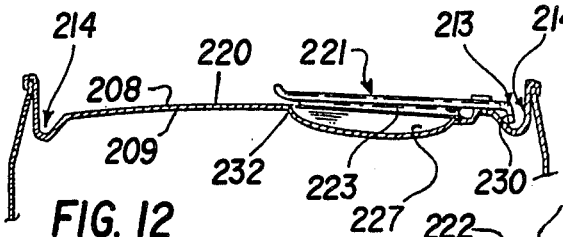
FIG. 12 is a section view taken along the line C—C of FIG. 11.

As shown in FIGS. 11 and 12, finger portion 213 includes a stop 230 that is adapted to engage the inner edge of the chime 214 as the opening tab 221 is lifted. The distance between the stop 230 and the surface of the chime 214 determines the extent to which the opening tab 221 can be lifted as illustrated in FIG. 15.

Figure 14:
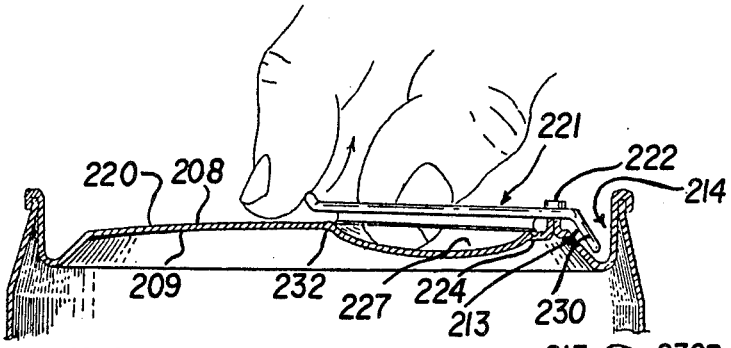
FIGS. 14, 15 and 16 show successive steps of the container opening procedure used with the embodiment of FIG. 11
Figure 15:
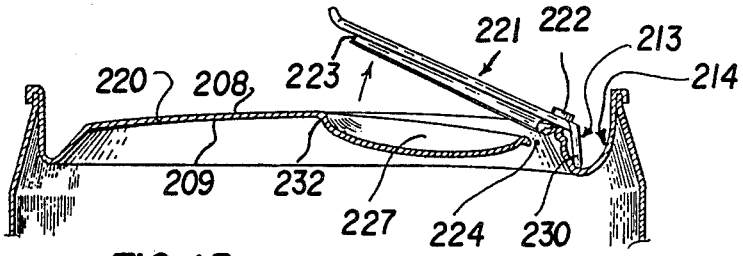
Figure 16:
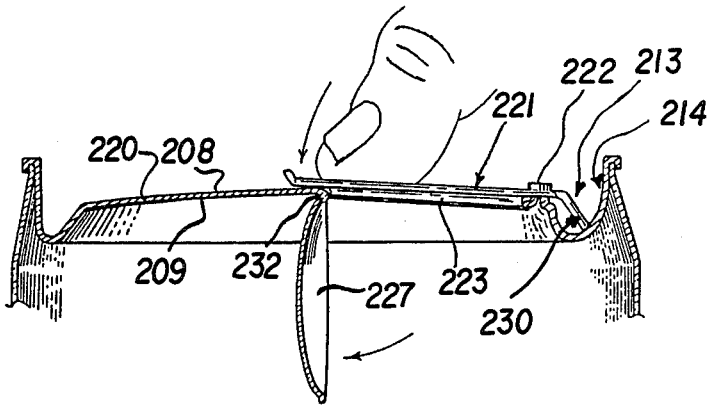

FIGS. 14–16 illustrate successive steps in the process of opening a container having the third embodiment of the present invention. A consumer simply inserts his thumb through the aperture 229 and grasps the end of the opening tab 221 with his forefinger as shown in FIG. 14. The opening tab 221 is then lifted until the lift stop 230 engages the inner wall of the chime as seen in FIG. 14. As the tab 221 begins to move, a downward force is exerted on the outer surface of the wall 220 by the finger portion 213. The finger 213 is not pressing on any portion of the panel 227 or score 225. In the present embodiment, the stress introduced into the material of the end wall 220 adjacent the rivet 222 and in the area of the score 225 causes the score 225 to sever and release the pressure within the can. The released pressure in conjunction with the stress and fatigue in the material of the end wall 220 causes the end wall 220 to flex, and in turn causes the score 225 to separate substantially along its entire length on each side of the hinge 226 of the panel 227.

Upon severance of the score 225, the consumer pivots the opening tab 221 down towards the end wall 220 and presses it over the rim 207 formed by the separated panel 227. Locking flange 223 simultaneously forces the panel 227 to hinge downwardly into the container at hinge point 232 and snaps into locking engagement with at least a portion of the rim 207 and the inner surface 209 of the end wall 220 as shown in FIG. 16. As in prior embodiments, the locking engagement of the flange 223 with the end wall 220 results in the tab 221 not being an obstruction to consumption of the contents of the container and covers the sharp edges of the opening. The temptation and ability of the user to remove the tab 221 from the container 218 is, therefore, virtually eliminated.

Figure 12A:
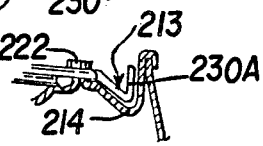
FIG. 12*a* is an enlarged sectional view of a portion of FIG. 12 showing the cooperation of the tab finger and container chime.
Figure 13:
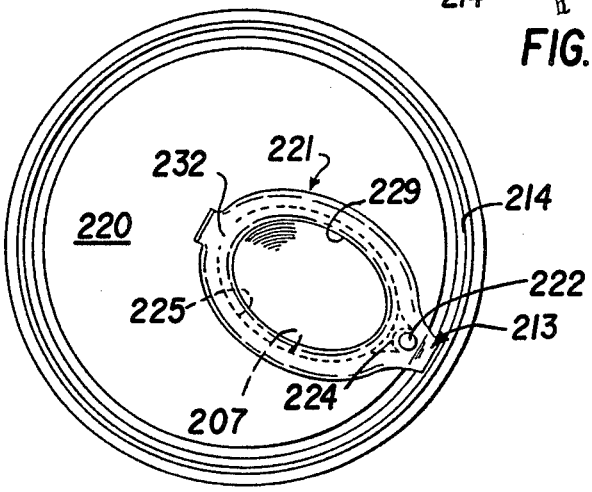
FIG. 13 is a top plan view of the container end shown in FIG. 11.
Figure 14A:
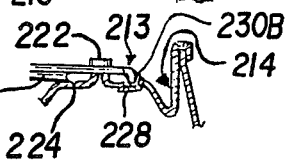
FIG. 14*a* is a sectional view showing an alternate embodiment of the finger portion of the tab shown in FIG. 11.

Alternate embodiments of the lift stop are shown in FIGS. 12*a* and 14*a*. In FIG. 12*a*, finger portion 213 includes an engagement means 230A which is generally shaped to fit within the curvature forming a portion of the chime 214 in the end wall 220. The finger engagement means 230B of finger portion 213 shown in FIG. 14*a* does not extend into or cooperate with the chime 214 of the end wall 220 at all but rather engages a depression 228 formed in the end wall 220 upon lifting of the tab 221.

One example of a score that has been found to be effective is the so-called Alcoa B48 score developed by The Aluminum Company of America.

While the invention has been described in terms of preferred embodiments, it is understood that additions, deletions and modifications can be made to these embodiments without departing from the spirit and scope of the invention as set forth in the claims.

What is claimed is:

1. An easy-opening container comprising:

a container wall having an outer surface and an inner surface;

an openable panel at least partially defined in said wall by a selectively separable region of predetermined weakness for forming an opening in said wall;

a tab having a securement means, said securement means connecting said tab to the outer surface of said wall in substantially flat alignment with said outer surface;

said tab having a finger portion on one side of said securement means and a lift portion on the opposing side of said securement means;

said finger portion of said tab lying remote from said separable region and said openable panel;

said lift portion of said tab having a locking engagement means on at least a portion of the underside thereof for cooperative engagement with at least a portion of the periphery of the opening in said wall and with at least a portion of the inner surface of said wall upon separation of said openable panel from said wall;

said lift portion overlying at least a portion of said wall outside of said separable region before and after said region has been separated from said wall;

said tab being operative for selective movement along at least a first and second path;

at least a portion of said separable region becoming separated from said wall when said tab moves along said first path;

and substantially all of said separable region becoming separated when said tab moves on said second path.

2. Apparatus as in claim 1 wherein said lift portion is generally annular.

3. Apparatus as in claim 1 wherein said lift portion and said locking engagement means on the underside of said lift portion are in confronting relationship with at least a portion of said separable region.

4. Apparatus as in claim 1 wherein said lift portion includes a portion which overhangs at least a portion of said wall located inside of said separable region forming said openable panel before said region has become separated from said wall.

5. Apparatus as in claim 1 wherein said locking engagement means of said lift portion of said tab is tapered so that a deeper angle of said flange is located in that portion of the lift portion furthest away from said retaining means in said wall.

6. Apparatus as in claim 1 wherein said locking engagement means of said ring portion of said tab is located at a portion of said lift portion furthest away from said securement means.

7. Apparatus as in claim 1 further including an interruption in said selectively separable region for hingedly attaching said openable panel to said container wall.

8. An easy-opening container comprising a container wall having an outer surface and an inner surface, a tab engagement means formed in said wall;

an openable panel at least partially defined in said wall by a selectively separable region of predetermined weakness;

a tab having a securement means and being secured by said securement means to the outer surface of said wall in substantially flat alignment with said outer surface;

said tab having a finger portion and a cooperative wall engagement means contiguous to said finger portion on one side of said securement means and a lift portion on the other side of said securement means;

said finger portion of said tab lying remote from said separable region and said openable panel;

said lift portion of said tab having a locking engagement means on at least a portion of the underside thereof for cooperative engagement with at least a portion of said periphery of the opening in said wall and with at least a portion of said inner surface of said wall upon separation of said openable panel from said wall;

said lift portion overlying at least a portion of said wall outside of said separable region before and after said separable region has become separated from said wall;

said tab being operative for selective movement along at least a first and second paths;

at least a portion of said separable region becoming separated from said wall when said tab moves along said first path;

said tab engagement means of said finger portion moving into cooperative engagement with said engagement means of said wall limiting said movement of said tab when said tab continues along said first path after said wall has become separated;

all of said separable region becoming separated when said tab moves along said second path.

9. Apparatus as in claim 8 wherein said tab finger portion includes an engagement means at the tip end for cooperative engagement with at least a portion of said engagement means formed in said wall.

10. Apparatus as in claim 8, wherein said engagement means of said wall and said cooperative engagement means of said finger portion of said tab are spaced a predetermined distance apart permitting movement of said ring portion of said tab a predetermined distance above said wall before said tab engagement means contacts engagement means of said wall restricting further movement of said tab while said tab is on said first path.

11. A container wall having an outer surface and an inner surface and includes a curvature forming a chime area completely surrounding the outer periphery of said wall;

an openable panel at least partially defined in said wall by a selectively separable region of predetermined weakness;

a tab having a securement means, and being secured by said securement means to said wall in substantially flat alignment with said outer surface;

said tab having a finger portion and a wall engagement means on one side of said securement means and a ring portion on the other side of said securement means, and said ring portion having a locking engagement means on at least a portion of the underside thereof for cooperative engagement with at least a portion of the rim of said wall and with at least a portion of the inner surface of said wall upon separation of said openable panel from said wall;

said ring portion overlaying at least a portion of said wall outside of said separable region before and after said separable region has become separated from said wall;

said tab being operative for selective movement relative to said container wall, at least a portion of said separable region becoming separated from said wall upon movement of said tab.

12. An apparatus as in claim 11 wherein said engagement means of said finger portion of said tab engages said wall in the vicinity of said curvature of said wall limiting the distance said tab can travel away from said wall

13. An apparatus as in claim 11 wherein:

said tab ring portion is movable along at least a first path and wherein said finger portion of said tab exerts a jamming force against said wall when said tab is moved a limited distance along said first path, and wherein said movement of said tab ring portion along said first path causes a lifting force in said wall in the vicinity of said securement means and said separable region causing at least a portion of said separable region to separate from said wall.

14. An apparatus as in claim 11 wherein said flange means of said lift portion of said tab is in engagement with at least a portion of said hinge means of said panel when said panel is moved downward into said container by said locking flange means.

15. An apparatus as in claim 11 wherein said openable panel is concave relative to said outer surface.

16. An apparatus as in claim 11 wherein said openable panel is convex relative to said outer surface.

17. An apparatus as in claim 11 wherein:

said locking flange means of said tab is sized and shaped so as to engage (in cooperative engagement) with at least a portion of said inner surface of said wall when at least a portion of said openable panel has been moved a limited distance away from said wall.

18. An easy-opening container comprising:

a top wall having a line of predetermined structural weakness extending from opposite ends of a hinge line with said weakness and hinge lines together surrounding and defining a partially separable panel section of said top wall;

a pull tab including a ring-shaped portion at one end, a finger portion at its other end and a mounting portion intermediate said ends;

said pull tab being mounted at its mounting portion to said top wall adjacent said panel section with its generally ring-shaped portion extending in overlying relationship with and at least partially framing said panel section and said finger portion extending from the opposite side of said mounting portion for depressing engagement with said top wall;

said ring-shaped portion including a lock means depending therefrom with said lock means being formed for locking engagement with at least said hinge line of said panel section upon separation of said panel section;

whereby movement of the tab ring-shaped portion away from the top wall causes the finger portion and the top wall to engage, separating the line of structural weakness and at least partially separating the panel from the top wall, and subsequent movement of the ring-shaped portion toward the top wall engages the lock means with the hinge line and further separates the panel from the top wall and pivots the panel downwardly into the container and locks the tab into engagement with the top wall surrounding the opening.

19. The container of claim 18 further comprising means for limiting upward movement of said tab ring-shaped portion, said limiting means comprising a lift stop formed in said top wall adjacent said finger portion and positioned to engage said finger portion upon movement of said ring-shaped portion a predetermined distance away from said wall.

20. The container of claim 19 wherein said finger portion is formed to define a lift stop engaging means adapted to cooperate with said lift stop upon upward movement of said ring-shaped portion.

21. The container of claim 18 wherein said ring-shaped portion has an inner periphery, said inner periphery at least partially overlying the outer periphery of said separable panel section.

22. The container of claim 18 further comprising a pair of opposed finger grips extending outwardly from opposite sides of said ring-shaped portion.

23. The container of claim 18 wherein said panel section is convex relative to said outer surface

24. The container of claim 18 wherein said panel section is concave relative to said outer surface.

25. The container of claim 24 wherein said top wall is substantially disk-shaped and wherein said panel section is defined adjacent the periphery of said top wall, said pull tab being mounted to said top wall at a point remote from said periphery with said ring-shaped portion extending from the mounting portion of said pull tab generally toward said wall periphery.

26. The container of claim 24 wherein said hinge line of said panel section is formed adjacent said pull tab mounting portion.

27. The container of claim 18 wherein said top wall is substantially disk-shaped and includes a peripheral chime formed therein and wherein said pull tab is mounted to said top wall between said separable panel and said chime with said finger portion extending at least partially into said chime and being positioned to engage said chime upon movement of said ring-shaped portion away from said top wall.

28. An easy-opening container comprising:

a substantially disk-shaped end wall having a score line extending from either end of a hinge line with said score and hinge lines defining a partially separable panel section of said end wall;

an opening tab having a generally ring-shaped first end, a second end and a mounting portion intermediate said ends, said opening tab being pivotably mounted at said mounting portion to said end wall adjacent said panel section;

the first end of said tab extending from said mounting portion to overlie and at least partially frame said panel section;

said second end extending from said mounting section to overlie at least a portion of said end wall and being positioned to engage said end wall remote from said panel upon movement of the first end of said tab away from said end wall.

29. The container of claim 28 further comprising a flange depending from said first end in confronting relationship with at least a portion of said score line, said flange being constructed and arranged for locking engagement with said score line upon separation of said panel section from said end wall.

30. The container of claim 28 wherein said end wall has a peripheral portion and a central portion and wherein said panel section is located intermediate said central and peripheral portions, said opening tab being mounted to said end wall at said central portion with said first end extending over said panel section.

31. The container of claim 30 wherein said opening tab further includes a pair of elongated finger grips extending outwardly from said first end of said opening tab adjacent the peripheral portion of said end wall.

32. The container of claim 28 wherein said end wall has an inner surface and an outer surface and wherein said panel section is concave relative to said end wall outer surface.

33. The container of claim 28 and wherein said end wall has an inner surface and an outer surface and wherein said panel section is convex relative to said end wall outer surface.

34. The container of claim 28 wherein said end wall has a peripheral portion and a central portion and wherein said peripheral portion includes a chime surrounding said end wall, said panel section being spaced from said chime and said opening tab being mounted to said end wall between said panel section and said chime with said opening tab first end extending over said panel section.

35. The container of claim 34 wherein said opening tab second end at least partially overlies said chime, said second end being constructed and arranged to engage said chime upon movement of said tab first end away from said end wall.

36. An easy-opening container comprising:

a substantially disk-shaped container wall including an inner surface and an outer surface, a peripheral portion and a central portion;

an openable panel section at least partially defined in said wall by a selectively separable region in said wall of predetermined structural weakness so that the panel section can separate from the rest of said wall to form an opening in said wall;

a pull tab being formed with a generally ring-shaped lift portion, a finger portion and a mounting portion intermediate said lift portion and said finger portion;

said pull tab being pivotally mounted at its mounting portion to said container wall adjacent said openable panel section with said lift portion overlying and at least partially framing the panel section;

said finger portion extending from said mounting portion to at least partially overlie said wall at a position remote from said panel section and being constructed and arranged to engage said wall upon movement of said lift portion away from said wall;

a locking means depending from said lift portion in generally confronting relationship with at least a portion of said region of predetermined structural weakness, said locking means being constructed and arranged for locking engagement with the rim of the opening formed by the separation of said panel section from said wall.

37. The container of claim 36 wherein said panel section is positioned intermediate said wall peripheral portion and central portion and wherein said pull tab is mounted to said wall at its central portion with said tab lift portion extending generally outwardly from said central portion to overlie said panel section.

38. The container of claim 36 further comprising a pair of opposed finger grips extending outwardly from said lift portion.

39. The container of claim 36 wherein said wall peripheral portion has a chime formed therein surrounding said wall and wherein said panel section is positioned between said chime and said wall central portion, said pull tab being mounted to said wall between said chime and said panel section with said lift portion overlying said panel section, said finger portion extending from said mounting portion at least partially into said chime and being constructed and arranged to engage at least a portion of said chime upon movement of said lift portion away from said wall.

40. An easy opening container comprising:

a container wall;

an openable panel partially defined by a U-shaped separable line of predetermined weakness and a hinge area extending between the ends of the U-shaped line;

a tab including at one end a lift portion, at its other end a finger portion and a securement portion intermediate its ends:

a securement means connecting said tab at its securement portion to the container at a position adjacent the panel with said lift portion overlying said panel and said finger portion extending from said securement means away from said panel;

whereby when the lift portion of the tab is moved away from the container wall the finger portion pivots down toward the container wall to depress the container wall and the securement means is lifted in a direction away from the container wall so that the container wall is flexed and the line of separable weakness separates and the panel opens.

* * * * *